US006789719B2

(12) United States Patent
Shor

(10) Patent No.: US 6,789,719 B2
(45) Date of Patent: Sep. 14, 2004

(54) FORWARD ACTING STAPLER WITH UNIQUE LINKAGE

(75) Inventor: Ilya Shor, Brooklyn, NY (US)

(73) Assignee: Arrow Fastener Co., Inc., Saddlebrook, NJ (US)

( * ) Notice: Subject to any disclaimer, the term of this patent is extended or adjusted under 35 U.S.C. 154(b) by 0 days.

(21) Appl. No.: 10/285,719

(22) Filed: Nov. 1, 2002

(65) Prior Publication Data

US 2004/0084504 A1 May 6, 2004

(51) Int. Cl.[7] ..... B25C 1/02
(52) U.S. Cl. ..... 227/132; 227/120; 227/134
(58) Field of Search ..... 227/132, 120, 227/134

(56) References Cited

U.S. PATENT DOCUMENTS

| | | | | |
|---|---|---|---|---|
| 1,830,650 A | * | 11/1931 | Falk | 227/124 |
| 2,326,540 A | | 8/1943 | Krantz | |
| 2,361,483 A | * | 10/1944 | Lang | 227/132 |
| 2,492,509 A | * | 12/1949 | Vandervieren | 227/132 |
| 2,493,640 A | * | 1/1950 | Peterson | 227/132 |
| 2,769,174 A | | 11/1956 | Libert | |
| 2,884,636 A | * | 5/1959 | Abrams | 227/132 |
| 3,913,817 A | | 10/1975 | Barrett | |
| 4,629,108 A | | 12/1986 | Judge | |
| 5,009,356 A | | 4/1991 | Chang | |
| 5,165,587 A | | 11/1992 | Marks | |
| 5,232,142 A | * | 8/1993 | Reichert et al. | 227/134 |
| 5,328,075 A | | 7/1994 | Marks | |
| 5,335,839 A | | 8/1994 | Fealey | |
| 5,407,118 A | | 4/1995 | Marks | |
| 5,427,299 A | | 6/1995 | Marks | |
| D360,566 S | | 7/1995 | Marks | |
| 5,497,932 A | | 3/1996 | Brewer | |
| 5,505,362 A | | 4/1996 | Marks | |
| 5,511,716 A | | 4/1996 | Marks | |
| D384,257 S | | 9/1997 | Marks | |
| D384,258 S | | 9/1997 | Marks | |
| 5,664,722 A | | 9/1997 | Marks | |
| 5,699,949 A | | 12/1997 | Marks | |
| 5,765,742 A | | 6/1998 | Marks | |
| 5,816,470 A | | 10/1998 | Plato | |
| 5,979,736 A | | 11/1999 | Edelholt | |
| 5,988,478 A | | 11/1999 | Marks | |
| 6,131,788 A | | 10/2000 | Marks | |
| 6,145,728 A | | 11/2000 | Marks | |
| 6,355,892 B1 | | 3/2002 | Marks | |

FOREIGN PATENT DOCUMENTS

DE 31 26 536 A1 1/1983

* cited by examiner

*Primary Examiner*—Stephen F. Gerrity
*Assistant Examiner*—Michelle Lopez
(74) *Attorney, Agent, or Firm*—Carlson, Gaskey & Olds

(57) ABSTRACT

A forward acting stapler includes a unique linkage for driving a firing lever. The linkage includes two links which are each connected to the trigger lever by a roller. The roller is movable within a spot in the trigger lever. As the handle is driven, the two links cause the triggering level to pivot. As the trigger lever pivots it lifts a plunger against a spring force. At some point, the trigger portion releases the plunger allowing the plunger to be returned by the spring force by a staple.

14 Claims, 5 Drawing Sheets

FORWARD ACTING STAPLER WITH UNIQUE LINKAGE

BACKGROUND OF THE INVENTION

This invention relates to a forward acting stapler.

Forward acting staplers are known in the art, and have a handle which is pivoted at one end of a stapler body. The handle is pivoted downwardly with the hand of the user received on an end of the handle remote from the pivot point. This end is generally vertically spaced above the location where a plunger and knife combination will drive a staple or nail into a workpiece. For purposes of this application, the term "plunger" should be understood to also include the knife which moves with the plunger. The forward acting stapler is an improvement over staplers which have the pivot point of the handle on the end of a stapler body which receives the plunger in that the force of the hand can be applied more directly to the plunger.

In the prior art, such forward acting staplers have been known for decades. However, the forward acting staplers known to date have had complex linkages which have made them difficult to use and sometimes unreliable.

SUMMARY OF THE INVENTION

The present invention provides a linkage including a handle lever which is connected by a pair of links to a trigger lever. In fact, each of the links have two sides which are positioned on each side of the handle lever in a preferred embodiment. The trigger lever is controlled to pivot as the firing handle is pivoted downwardly. The trigger lever has a trigger portion adjacent the end of the housing which receives the firing plunger. The two-part linkage between the handle lever and the trigger lever includes a first link pinned to the handle lever and which moves a roller. The roller is also fixed to a holding link which is pivotally attached to the housing. The roller is received in a slot in the trigger lever. The arrangement of the two links, the handle lever, and the trigger lever slot is such that as the handle lever is moved downwardly, the first link forces the roller to move in a direction to pivot the trigger lever in such a way that the trigger portion at the end of the trigger lever moves in a direction upwardly. When this movement occurs, the holding link causes the roller to move within the slot in a direction away from a pivot point of the trigger lever. The trigger portion of the trigger lever includes a member which is spring biased to a holding position at which it is received under a ledge on an actuating plunger. A flat power spring extends through the body of the stapler and biases the plunger to drive a staple or nail into a work surface once the plunger is released by the trigger lever.

As the handle is moved downwardly, the movement between the two links and the two levers continues with the trigger portion of the trigger lever continuing to pull the plunger upwardly against the force of the spring. During this movement, the geometry of the trigger portion tends to move the trigger away from the plunger. At some point, the power spring drives the plunger to drive a staple into the workpiece.

In a preferred embodiment, the trigger portion is mounted near the end of the trigger lever on a pair of pins and a bias spring combination. One pin is fixed to the trigger lever and is received within a slot in the trigger portion. The trigger portion has its own pin received in a slot on the trigger lever. A spring biases the trigger portion pin toward the trigger lever pin, and thus biases the trigger portion outwardly toward the plunger. This spring force holds the trigger portion under the plunger as the plunger is raised, and up until the firing point. When the trigger lever is returned after firing, this spring allows the trigger portion to cam along a ramp surface on the plunger and be returned beneath the plunger ledge.

The present invention provides a reliable and simplified linkage. Further, the trigger portion is also simple and yet quite reliable.

The present invention can be best understood from the following specification and drawings, the following of which is a brief description.

DETAILED DESCRIPTION OF THE PREFERRED EMBODIMENT

Figure 1:
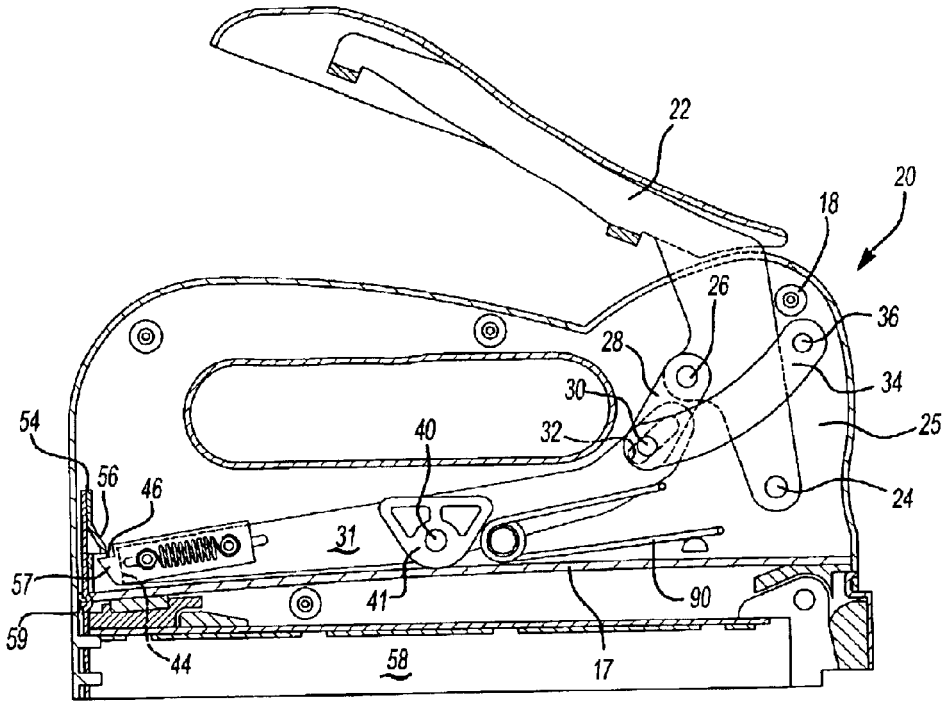
FIG. 1 shows a stapler in a relaxed position.

FIG. 1 shows a forward acting stapler 20. As shown, handle lever 22 is pivotally attached at pivot point 24 within a stapler housing 25. A pin creates a pivot point 26 pivotally connects a first link 28 to the handle lever 22. A roller 30 moves with the link 28, and is received in a slot 32 in a trigger lever 31. A holding link 34 also moves with the roller 30 and is pivotally attached at pivot point 36 to the stapler housing 25. Notably, the pivot point 36 and the pivot point 26 are on opposed sides of the handle lever 22, and on opposed sides of the pivot point 24. Also, notably, in this figure, the roller 30 is spaced toward the left hand side of the forward acting stapler 20 from pivot points 26, 24 or 36. The trigger lever 31 is pivotally connected at pivot point 40 to the housing by a structure having a surface 41 in contact with an upper surface of an elongate power spring 17. A trigger portion 46 of the trigger lever 31 extends forwardly of the nominal end 44 of the trigger lever 31. The trigger portion is mounted on the trigger lever with a pin/spring arrangement which will be described below.

A plunger 54 includes a plunger ledge 56 which is generally aligned with a forward portion 57 of the trigger portion 46. A magazine 58 indexes staples or nails to a position under the plunger, such that the plunger can drive the staple or nail into a work surface. A forward end 59 of the elongate power spring 17 is also received in the plunger.

The return spring 90 holds the handle lever 22 against a handle stop 18 in this position.

Generally, as the handle lever 22 is pivoted downwardly it causes the trigger lever 31 to pivot clockwise as shown in this figure. As this occurs, the forward portion 57 lifts the plunger 54 through the plunger ledge 56 mid against the force of the elongate power spring 17. The forward portion 57 continues to lift the plunger 54 to a point at which the plunger 54 becomes disengaged from the trigger portion.

Figure 2:
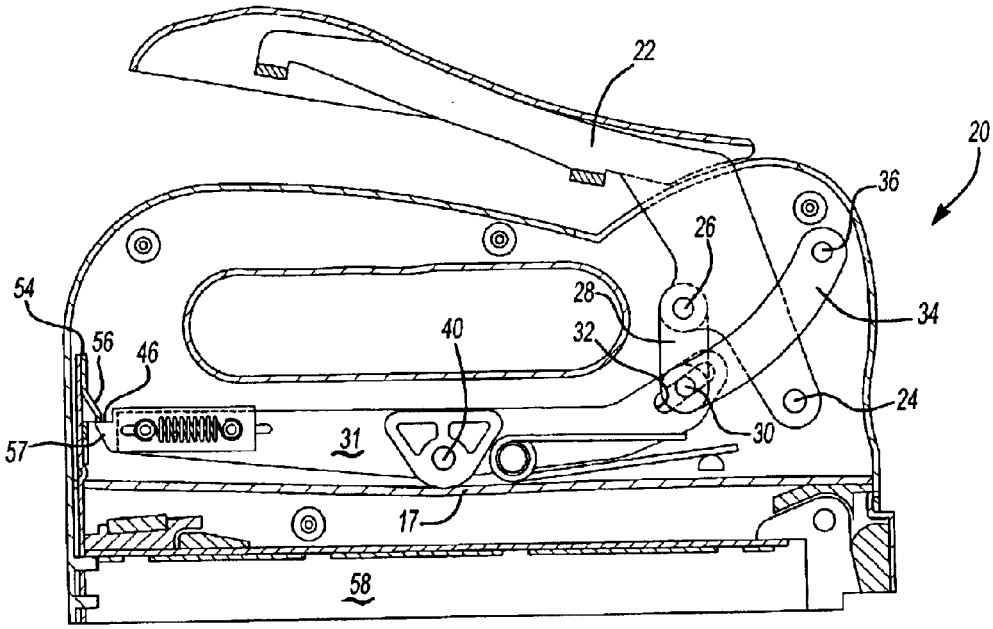
FIG. 2 shows a point during the initial movement of the stapler towards a firing position.

As shown in FIG. 2, as the handle lever 22 begins to be pivoted about pivot point 24 and counterclockwise as shown in this figure, the connection of the handle lever 22 to pivot point 26 also drives the links 28 and 34 in a similar direction. As this movement occurs, the roller 30 moves within the slot 32. However, with such movement the link 34 begins to constrain the roller 30 to move downwardly and to the right as shown in this figure which increases the distance between pivot point 40 and roller 30 (see FIGS. 5B and 5C). When this occurs, the trigger lever 31 also begins to pivot about its pivot point 40, downwardly with the roller 30. As this occurs, and as can be seen in the left side of FIG. 2, the forward portion 57 begins to lift the plunger ledge 56, lifting the plunger 54. As is clear from this figure, the elongate power spring 57 begins to flex, and urge the plunger in an opposed direction.

Figure 3:
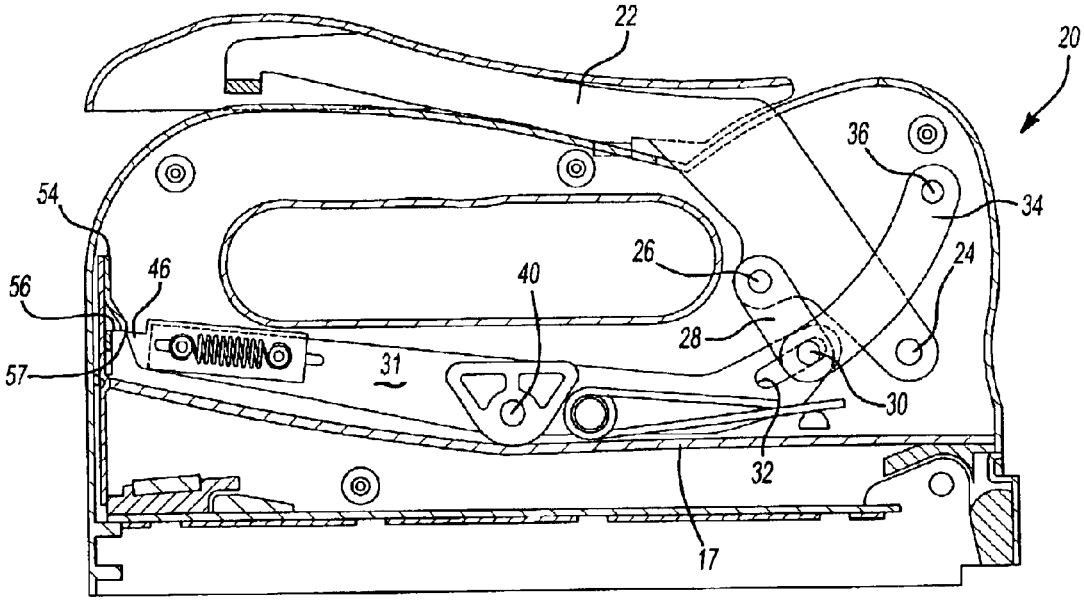
FIG. 3 shows a point subsequent to the FIG. 2 point.

As the handle lever 22 continues to pivot as shown in FIG. 3, the trigger portion 46 eventually begins to move away from the plunger ledge 56. At the point shown in FIG. 3, the linkage is about to fire the plunger.

Figure 4:
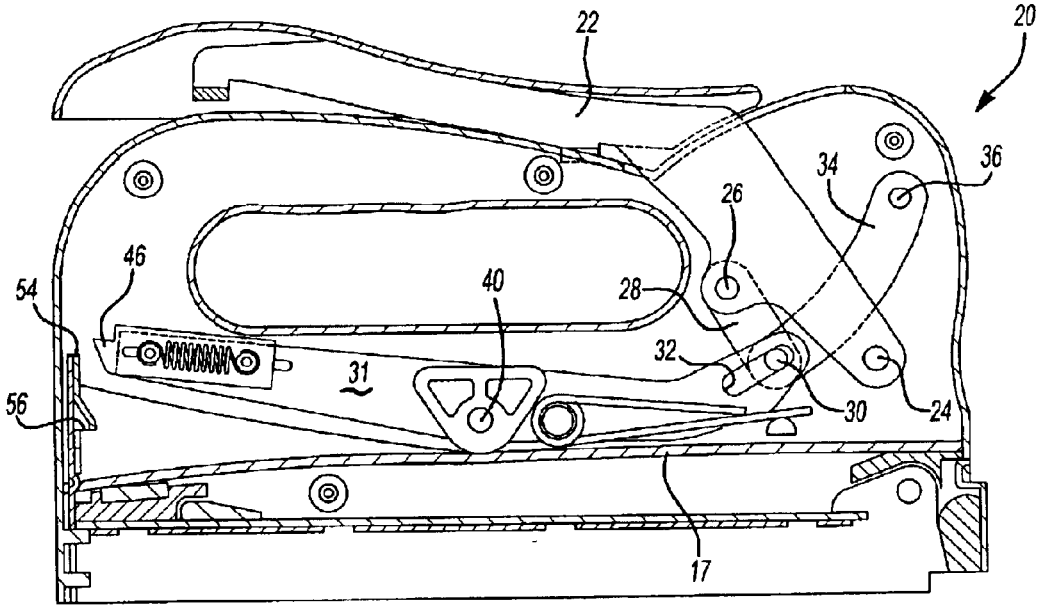
FIG. 4 shows yet another subsequent point.

As shown in FIG. 4, the trigger portion 46 of the trigger has now allowed the plunger ledge 56 to move past. The elongate power spring 57 then fires the plunger 54 back downwardly. With this movement a staple or nail is driven into a workpiece as known.

Figure 5A:
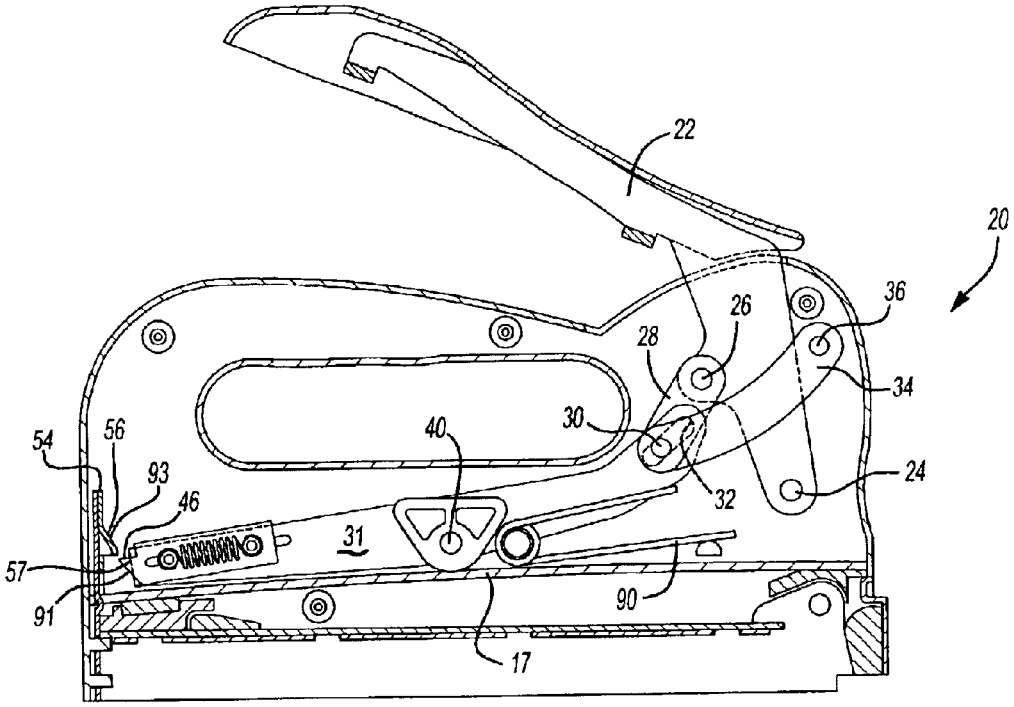
FIG. 5A shows yet another subsequent point.

As shown in FIG. 5A, the staple has now been fired. A return spring 90 now provides a return force driving the linkages back to the FIG. 1 position. As shown in FIG. 5, the trigger portion 46 of the trigger lever 31 has moved past the top of the plunger ledge 56. During this movement, a ramped surface 91 underneath the forward portion 57 and a ramped surface 93 above the plunger ledge will allow the forward portion to move further to the right until eventually it can move beyond the plunger ledge 56. At this point, the system will return to the position as shown in FIG. 1.

Figure 5B:
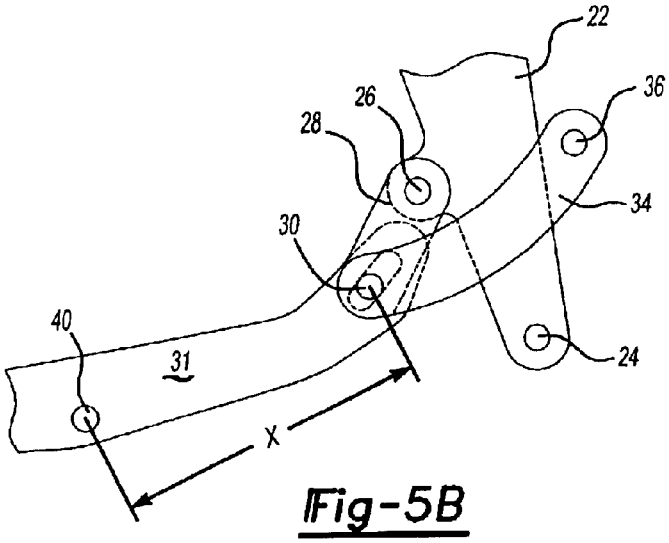
FIG. 5B shows the position of the linkages and roller at the beginning of movement.
Figure 5C:
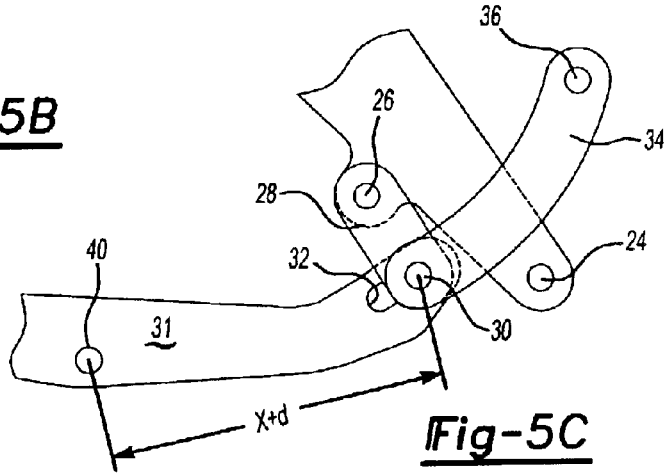
FIG. 5C shows a point subsequent to the FIG. 5A point, and in particular the firing point.

As shown in FIGS. 5B and 5C, the distance between pivot point 40 and the roller 30 will change between the rest position and the firing point. As shown, if the distance between the two at rest (FIG. 5B) is X, then at the firing point (FIG. 5C) the distance is X+d. This change in distance controls movement as set forth above.

Figure 5D:
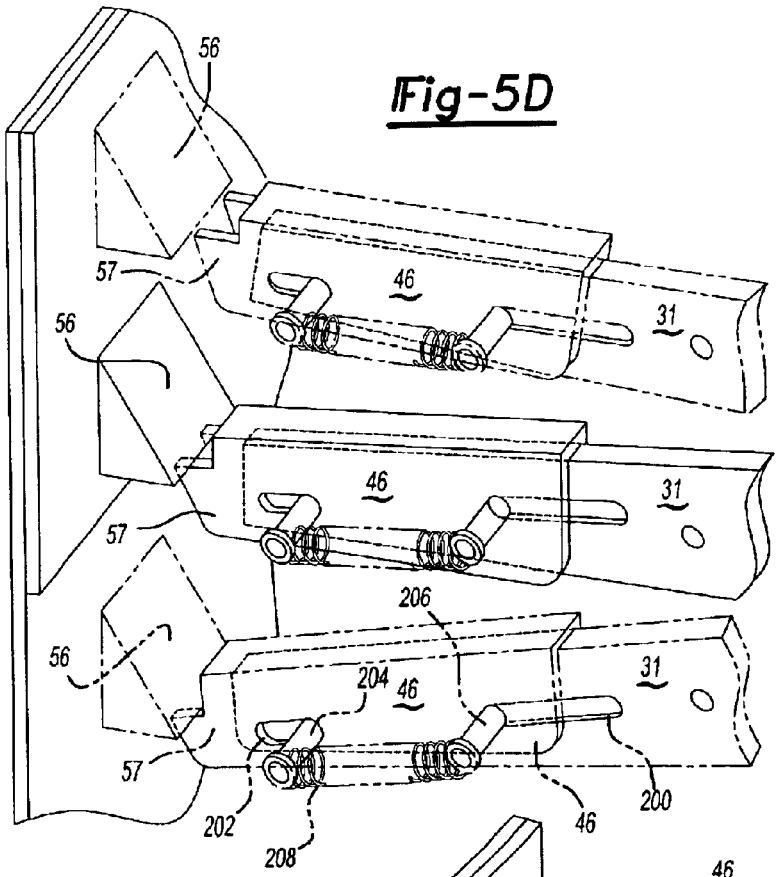
FIG. 5D shows the structure and movement of the trigger portion as it moves toward the firing point.
Figure 5E:
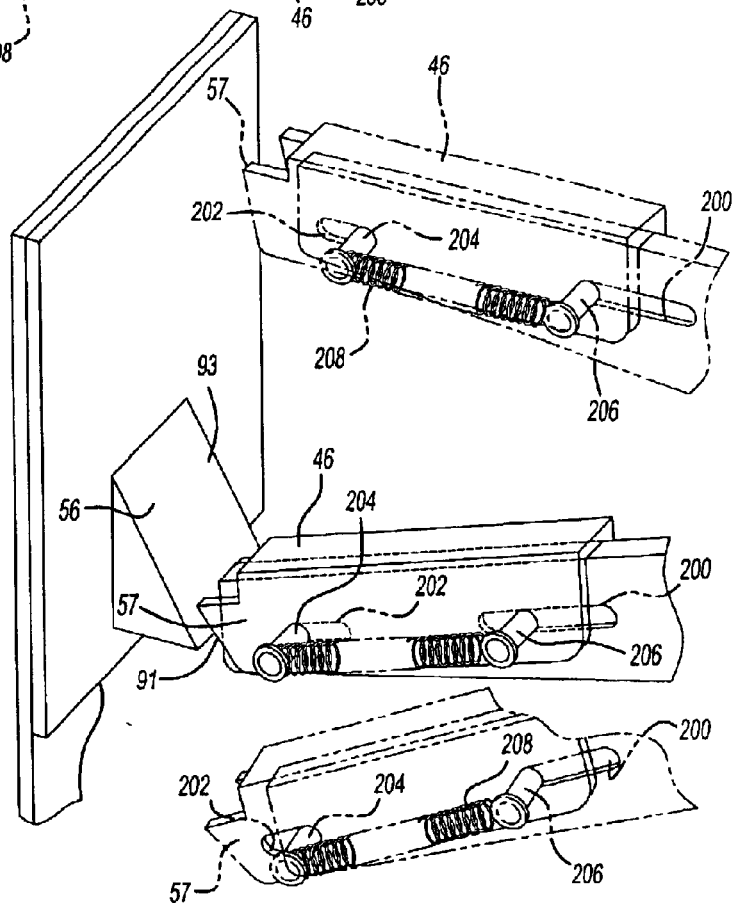
FIG. 5E shows the structure and movement of the trigger portion as it is returned to its original rest position.

Further details of the trigger portion and trigger lever are shown in FIGS. 5D and 5E. FIG. 5D shows the movement as the trigger lever 31 is being driven to lift the plunger. As shown, the forward portion 57 of the trigger lever 31 is retained beneath the plunger ledge 56. A pin 204 attached to the trigger lever 46 and is movable within a slot 202 in the trigger portion 46. A pin 206 is fixed to the trigger portion 46 and is movable within a slot 200 in the trigger lever. A spring 208 biased the pin 206 toward to the pin 204, thus drawing the trigger portion 46 to the left as shown in this figure and beneath the plunger ledge 56. As can be seen, the trigger portion 46 spans both sides of the trigger lever 31. Thus, both pins 204 and 206 preferably extend through the trigger lever 31 and are received in both sides of the trigger portion 46.

The two pin and spring combination serves to allow the trigger portion to return to the rest position once the staple or nail has been fired. FIG. 5E shows the movement back to the FIG. 5A position. As shown in FIG. 5E, the ramped surface 91 cams along the ramped surface 93 of the plunger ledge 56. During this movement, the trigger portion 46 is forced to the right. Pin 206 can move within the slot 200, while the pin 204 moves within the slot 202. As shown in the intermediate position in FIG. 5E, this movement guides the trigger portion as it moves along the ramped surface 93. Once the forwardmost portion 57 of the trigger portion 46 is moved beyond the plunger ledge 56, the spring 208 returns the trigger portion 46 back to the left, such that it can again reach its rest position.

Figure 6A:
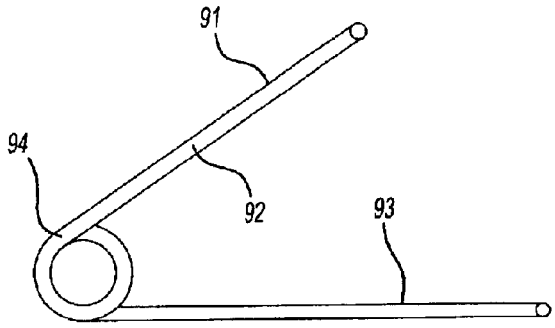
FIG. 6A shows a first view of a return spring.

As shown in FIG. 6A, the return spring 191 includes a first leg 192 and a second leg 193. In all positions shown within FIGS. 1–5, the return spring is biased away from this relaxed position.

Figure 6B:
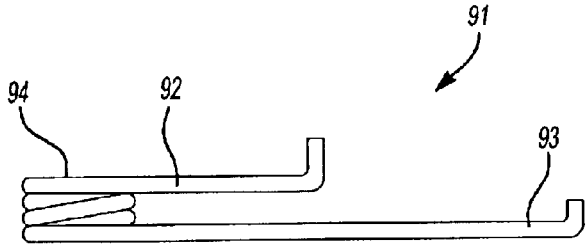
FIG. 6B shows a second view of the return spring.

FIG. 6B shows a top view of the return spring 91.

Figure 7:
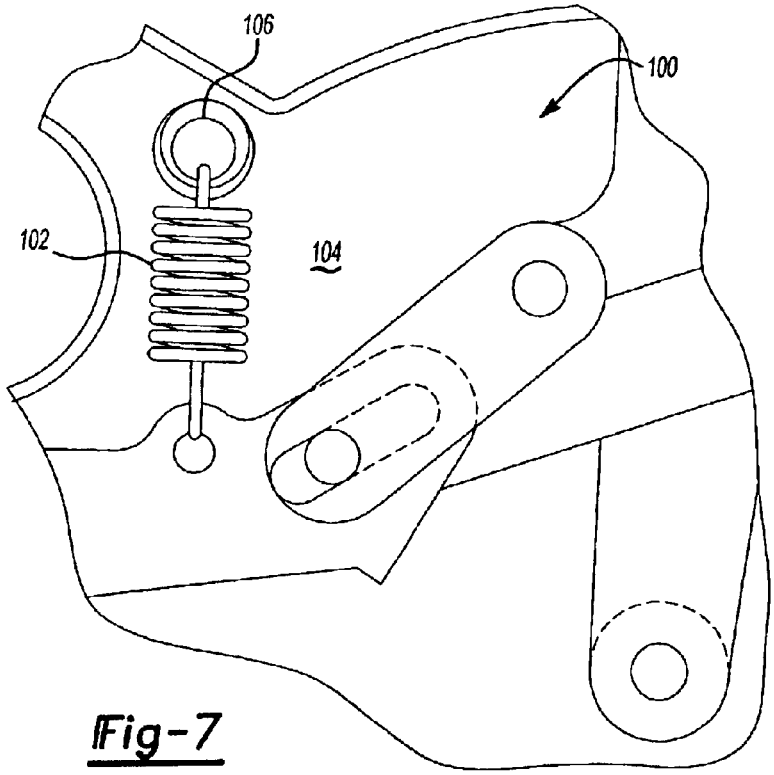
FIG. 7 shows an alternate embodiment.

FIG. 7 shows an alternative embodiment in which the return spring 100 is pivotally attached to both the housing 104 and to the trigger lever 106.

Preferred embodiments of this invention have been disclosed, however, a worker of ordinary skill in this art would recognize that certain modifications would come within the scope of this invention. For that reason, the following claims should be studied to determine the true scope and content of this invention.

What is claimed is:

1. A stapler comprising:

a handle extending upwardly above a housing and pivotally attached within said housing;

a pair of links each attached to a roller, with a first of said links being separate from and movable relative to said handle, and pivotally attached to said handle at a first pivot point and a second of said links being pivotally attached to said housing at second pivot point;

a trigger lever having a slot receiving said roller, said roller being pivotally attached to said housing at a trigger pivot point, and said trigger lever including a trigger portion;

said housing further including a plunger and a power spring for driving said plunger for driving a staple into a workpiece, said trigger portion of said trigger lever being operable to lift said plunger against the force of said spring as said handle is pivoted downwardly toward said housing about said pivot point, with said two links causing said trigger lever to pivot about its pivot point and with said plunger; and a longitudinal direction defined as being generally a direction along said trigger lever, and said handle is pivotally attached to said housing at a handle pivot point which is longitudinally intermediate said first pivot point and said second pivot point.

2. A stapler as recited in claim 1, wherein said first link pivot point is on a forward side of said handle defined as toward said plunger and said second pivot point link is on a rear side of said handle spaced away from said plunger such that the pivotal attachment of said first link to said handle is closer to said plunger than the pivotal attachment of said second link to said housing.

3. A stapler as recited in claim 1, wherein said roller being intermediate said plunger and each of said first and second pivot points.

4. A stapler as recited in claim 1, wherein said trigger portion being a part separate from said trigger lever.

5. A stapler as recited in claim 1, wherein said roller being intermediate said plunger, and each of said pivot points of said links to said handle and to said housing.

6. A stapler comprising:

a handle extending upwardly above a housing and pivotally attached within said housing;

a pair of links each attached to a roller, with a first of said links being separate from and movable relative to said handle and pivotally attached to said handle at a first pivot point and a second of said links being pivotally attached to said housing at a second pivot point;

said trigger lever being pivotally attached to said housing at a trigger pivot point, and said trigger lever including a trigger portion;

said housing further including a plunger and a power spring for driving said plunger for driving a staple into a workpiece, said trigger portion of said trigger lever being operable to lift said plunger against the force of said spring as said handle is pivoted downwardly toward said housing about said pivot point, with said two links causing said trigger lever to pivot about its pivot point and with said plunger;

said trigger portion is received under a ledge portion of said plunger; and said trigger portion is received on pins in said trigger lever, and said pins being spring biased to bias said trigger portion toward said plunger.

7. A stapler as set forth in claim 6, wherein said trigger portion receives a first pin and said trigger lever receives a second pin, said trigger portion lever being movable within a slot on said trigger lever and said trigger lever pin being movable within a slot on said trigger portion, a spring biasing said trigger portion pin toward said trigger lever pin to bias said trigger portion toward said plunger.

8. A stapler as set forth in claim 7, wherein a lower face of said trigger portion and an upper end of said plunger ledge are ramped to facilitate return movement of said trigger beyond said ledge.

9. A stapler comprising:

a handle to be pivoted relative to a stapler body to cause a trigger lever to pivot and cause upward movement of a plunger;

said plunger being driven by a power spring to return downwardly and fire a stapler;

said trigger lever including a trigger portion, said trigger portion being movable forwardly and rearwardly relative to said trigger lever and biased towards a forward position by a trigger spring, said trigger portion being received under a ledge on said plunger to lift said plunger as said trigger lever moves, said trigger spring having two ends, with one end attached to said trigger lever, and the other end attached to said trigger portion.

10. A stapler as set forth in claim 9, wherein said trigger portion is received on pins and a portion of said trigger lever, and said pins being spring biased to bias said trigger portion toward said plunger by said trigger spring.

11. A stapler as set forth in claim 10, wherein said trigger portion receives a first pin and said trigger lever receives a second pin, said trigger portion lever being movable within a slot on said trigger lever and said trigger lever pin being movable within a slot on said trigger portion, said trigger spring biasing said trigger portion pin toward said trigger lever pin to bias said trigger portion toward said plunger.

12. A stapler as set forth in claim 9, wherein a lower face of said trigger portion and an upper end of said plunger ledge are ramped to facilitate return movement of said trigger beyond said ledge.

13. A stapler comprising:

a handle extending upwardly above a housing and pivotally attached within said housing at a handle pivot point;

a pair of links each attached to a roller, with a first of said links being separate from and movable relative to said handle, and pivotally attached to said handle at a first pivot point and a second of said links being pivotally attached to said housing at a second pivot point, said first and second pivot points on opposed sides of said handle;

a plunger;

a trigger lever having a slot receiving said roller, said roller being intermediate said plunger, and said first and second pivot points, said trigger lever being pivotally attached to said housing at a trigger pivot point, and said trigger lever carrying a trigger portion;

said housing further including a plunger and a spring for driving said plunger for driving a staple into a workpiece, said trigger portion of said trigger lever being operable to lift said plunger against the force of said spring as said handle is pivoted downwardly toward said housing about said pivot point, with said two linkages causing said firing lever to pivot about its pivot point and with said plunger, said trigger portion being movable forwardly and rearwardly relative to said trigger lever and biased towards a forward position by a spring force, said trigger portion being received under a ledge of said plunger to lift said plunger as said trigger lever moves, and said trigger portion being operable to move away from said plunger and allow said plunger to be driven by said power spring.

14. A stapler as set forth in claim 13, wherein said trigger portion receives a first pin and said trigger lever receives a second pin, said trigger portion lever being movable within a slot on said trigger lever and said trigger lever pin being movable within a slot on said trigger portion, a spring biasing said trigger portion pin toward said trigger lever pin to bias said trigger portion toward said plunger.

* * * * *

UNITED STATES PATENT AND TRADEMARK OFFICE

CERTIFICATE OF CORRECTION

PATENT NO. : 6,789,719 B2
DATED : September 14, 2004
INVENTOR(S) : Shor

It is certified that error appears in the above-identified patent and that said Letters Patent is hereby corrected as shown below:

Column 4,
Line 34, “roller” should read as -- trigger lever --.
Line 50, delete “link”.

Column 6,
Line 20, insert -- being -- before “points” and after “on”.
Line 28, the first occurrence of “a” should read as -- said --.

Signed and Sealed this

Seventh Day of December, 2004

JON W. DUDAS
*Director of the United States Patent and Trademark Office*